US005493272A

United States Patent [19]

Beghelli

[11] Patent Number: 5,493,272

[45] Date of Patent: Feb. 20, 1996

[54] EMERGENCY LIGHTING SYSTEM WITH ALARM FOR FIRE, GAS AND AMBIENT AIR POLLUTION WITH AUTOMATIC MONITORING AND BATTERY RECHARGING

[75] Inventor: Gian P. Beghelli, Monteveglio, Italy

[73] Assignee: G. P. B. Beghelli S.r.l., Monteveglio, Italy

[21] Appl. No.: 187,805

[22] Filed: Jan. 27, 1994

Related U.S. Application Data

[63] Continuation of Ser. No. 804,119, Dec. 6, 1991, abandoned.

[30] Foreign Application Priority Data

Dec. 7, 1990 [IT] Italy ..... 4965/90 U

[51] Int. Cl.[6] ..... G08B 26/00

[52] U.S. Cl. ..... 340/505

[58] Field of Search ..... 340/505, 518, 340/825.07, 825.06, 825.54, 514, 691, 331, 332, 501

[56] References Cited

U.S. PATENT DOCUMENTS

| | | | |
|---|---|---|---|
| 4,206,450 | 6/1980 | Harden | 340/521 |
| 4,217,646 | 8/1980 | Caltagirone | 340/310 R |
| 4,316,185 | 2/1982 | Watrous | 340/636 |
| 4,468,655 | 8/1984 | Iwata | 340/505 X |
| 4,531,114 | 7/1985 | Topol | 340/332 X |
| 4,589,081 | 5/1986 | Massa | 340/501 X |
| 4,831,361 | 5/1989 | Kimura | 340/510 X |
| 4,945,280 | 7/1990 | Beghelli | 315/129 |
| 5,061,997 | 10/1991 | Rea et al. | 340/825.06 X |
| 5,105,370 | 4/1992 | Shaw | 340/501 X |

FOREIGN PATENT DOCUMENTS

| | | | |
|---|---|---|---|
| 2178878 | 2/1987 | United Kingdom | 340/505 |

OTHER PUBLICATIONS

Peatman, J. S., Microcomputer–Based Design, N.Y., McGraw–Hill, pp. 104–127, 312–318, 1977.

*Primary Examiner*—Hezron E. Williams
*Assistant Examiner*—Christine K. Oda
*Attorney, Agent, or Firm*—Herbert Dubno

[57] ABSTRACT

Emergency lighting system with alarm for fire, gas and ambient air pollution with automatic monitoring and battery recharging utilizing a bus and a microprocessor circuit whose input and output signals regulate the programming. A sensor for one or more environmental hazard factors is connected to the data bus.

3 Claims, 2 Drawing Sheets

EMERGENCY LIGHTING SYSTEM WITH ALARM FOR FIRE, GAS AND AMBIENT AIR POLLUTION WITH AUTOMATIC MONITORING AND BATTERY RECHARGING

This is a continuation of application Ser. No. 07/804,119 filed on 6 Dec. 1991, abandoned.

FIELD OF THE INVENTION

This invention relates to an improvement in "intelligent" independent emergency lighting systems, extended to fire emergencies, harmful-gas detection, ambient air pollution factors and the like.

BACKGROUND OF THE INVENTION

It is noted that systems defined as being "intelligent" exist for independent emergency lighting systems with operational self-diagnosis, which can be programmed and displayed and which can be centralized together with the electrical supply, with assembly and extensibility possibilities as far as the level of "intelligence" is concerned, on the basis of the performances required. All of these devices have the common feature that their emergency operation is activated at the moment of a main power failure, whether they are mounted with lamps for continuous lighting or with lamps for non-continuous and only emergency lighting. Under emergency conditions, electrical power is provided by special rechargeable batteries. An appropriate microprocessor can be used to check the recharging current and voltage of the batteries, the fault detection of the circuit and the lamps with the programming and performance of a visualized periodical functional test, and the programming and performance of an independence test at programmable intervals.

The results of period fault tests and independence tests are communicated to a centralized control and monitoring unit which can be activated remotely and which is also capable of receiving and transmitting operating orders to the individual emergency units. In addition, a microprocessor circuit can be included in the battery unit for the programming/performance of period functional tests on the connected lamps and for the programming/performance of independent tests at programmable intervals with the detection of defective lamps and the deactivation of one or more lamps.

It is also known that emergency lighting systems also exist that are equipped with a sensor for gas or fumes produced by combustion and/or with a sensor with a threshold photocell, complete with a processor for the signals emitted by a sensor and with a fire alarm or a general alarm including at least one emergency lamp, in addition to a sensor of the above mentioned type.

OBJECT OF THE INVENTION

The object of this invention is to extend the advantages of "intelligent" emergency lighting systems to other types of emergencies, such as detection of harmful toxic gas or gases with the risk of explosion, the development of combustion fumes with a principle of a fire, heat production and anomalous development of luminous energy connected to fire risks and emissions of any kind connected to ambient air pollution.

In particular, the intention is to take advantage of the capacity and potentiality of data transmission from the peripheral units to the central units of the "intelligent" systems for the purpose of centralizing not only the data relative to the non-exclusive functional diagnosis of the connected equipment, but also the data detected by the environmental sensors incorporated into the equipment itself.

SUMMARY OF THE INVENTION

According to the invention, in addition to the emergency lighting device of an intelligent system as described each lamp is equipped with a sensor having a different activation feature, or a combination of different sensors in order to detect one or more dangerous environmental characteristics, in order that one or more computers can send out an appropriate signal and, via a microprocessor joined with a transmitter/receiver across the data line, transmit it to the central microprocessor for activating the optical and/or acoustic alarm signals with the proper connection circuits, whether these be electrical conductors or radio waves.

The microprocessor sequentially "interrogates" the various circuit blocks, compares the responses received with the stored data and implements the appropriate operating strategies on the basis of the results of this comparison.

According to a feature, the single emergency device can send the alarm signal by means of a signal wave conveyed on the normal electrical network, even independently from the centralized control unit, activating, in this way, the acoustic and/or luminous alarms.

More particularly, the invention relates to an independent emergency lighting system having individual lighting devices and comprising means for detecting one or more environmental hazard factors, means for receiving and transmitting and analyzing emergency signals of a dangerous type, means for carrying out a programmed, visualized and centralized self-diagnosis, a means for supplying the individual lighting devices by a centralized battery unit with a programmable recharging circuit, and a circuit for determination of the charging condition and for detection of incipient fault conditions. The detecting means can include a microprocessor circuit whose input and output signals regulate programmed and sequential sequences affecting the centralized functions of control, testing and diagnosis of the emergency lighting circuits and of the fire, harmful and surrounding air pollution signals.

Means can be provided for activating remotely the system by radio or telephone connection.

The system can further comprise means for communicating remotely with the system by means of a wave signal conveyed on the normal electrical network.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
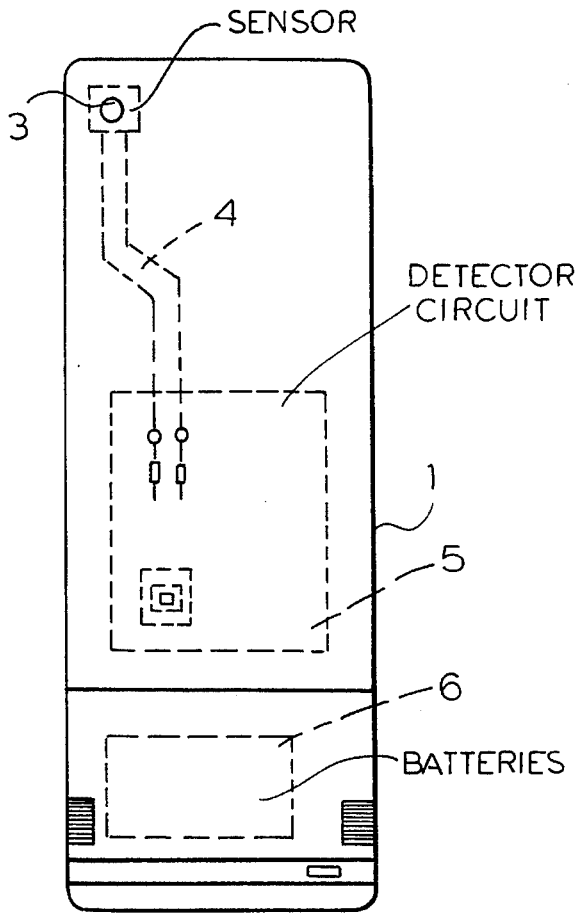
FIG. 1 is an elevational view which diagrammatically represents an emergency device.
Figure 2:
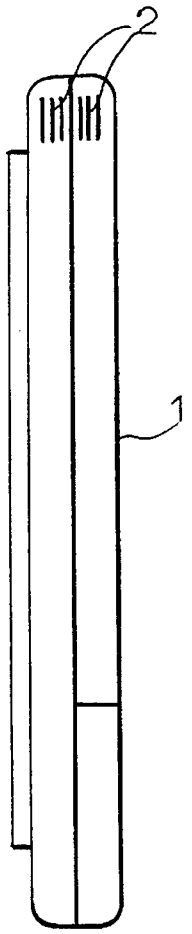
FIG. 2 is a side view of the apparatus.
Figure 3:
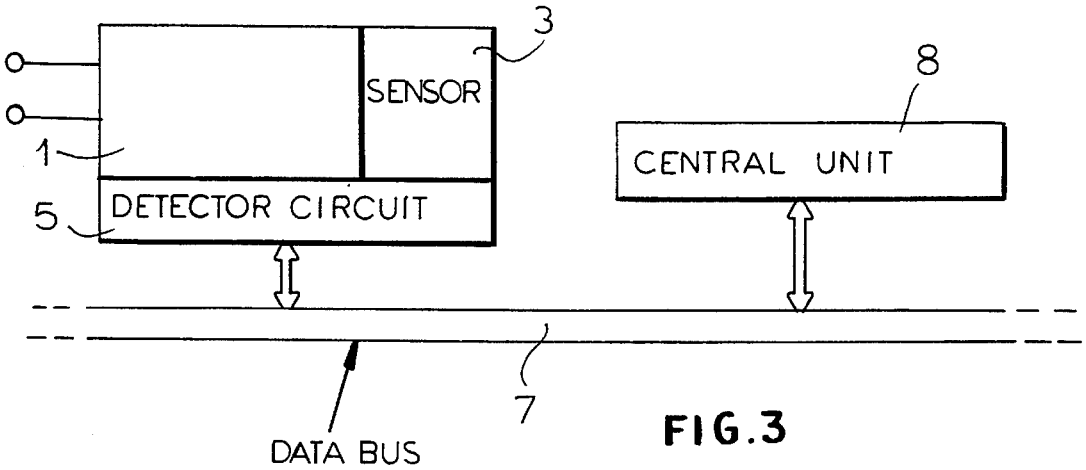
FIG. 3 is a block diagram which schematically illustrates the connection between the various elements of the system.

The device 1 (FIGS. 1–3) intercepts anomalous presences in the ambient air with sensor 3 via slits 2 and activates the entire circuit 5 with microprocessor and data transmitter/receiver by means of conductors 4. It can be provided with or without a lamp.

Rechargeable batteries 6 are included for emergency electrical supply.

Each device 1 is connected to the central unit 8 by means of data line 7.

Figure 4:
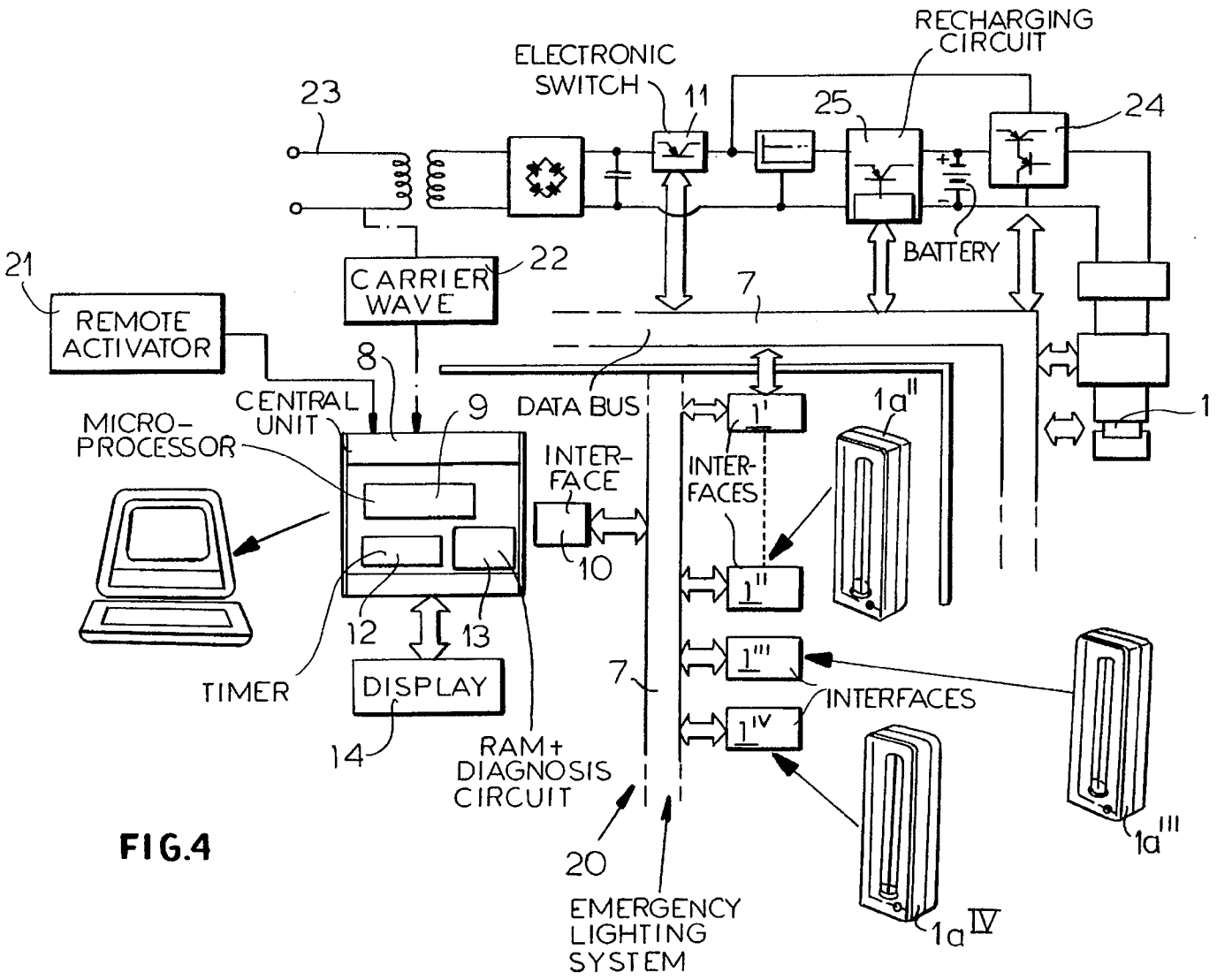
FIG. 4 is a block diagram which illustrates a complete diagram of an intelligent emergency system.

In FIG. 4, I show an exemplary diagram of a first level intelligence system, the data exchange circulates in DATA BUS 7 between the system's circuit blocks (that is to say, the emergency device, battery recharge check, activation emergency battery system, controlled electrical switch, current inverter) and the microprocessor 9 inserted in the central unit 8, which they reach and where they are exchanged with interface 10 of the common data bus.

A timer 12 for the operational frequency to microprocessor 9 and a display system 14 are the essential elements inserted in the central unit, along with the microprocessor 9.

The possibility the system offers of intervening with the signals on the electronic switch 11, allows the activation/deactivation of the entire emergency system.

Diagrams of a more complete level with random-access memory and a diagnosis circuit for the battery charge condition, represented at 13 allow for the memorization of the parameters of operating conditions and, from the comparison with the present state, a suitable operating strategy is set up.

As can be seen from FIG. 4, the emergency lighting system designated generally at 20 can include the individual lighting devices 1*a*", 1*a*'", 1*a*$^{IV}$ to the bus 7 and an interface 1' interconnecting portions of the bus 7.

The system also includes a remote activator 21 for activating remotely the system by a radio or telephone connection and means 22 for communicating with the system by means of a wave signal conveyed on the normal electrical network 23. The means for supplying the individual lighting devices can include a centralized battery unit represented generally at 24 equipped with a programmable recharging circuit 25 and circuitry for determination of the charging condition and incipient faults.

This invention fulfills the objects specified and, in particular, allows the improvement of the current emergency lighting systems by implementing and extending them to any type of emergency deriving from harmful gas, fire and surrounding air pollution, while increasing and completing the general level of safety and substantially reducing the burden of testing and preventive maintenance.

I claim:

1. A lighting system comprising:

a data bus;

a plurality of individual lighting devices connected to said bus for emergency lighting in response to signals transmitted along said bus, each of said lighting devices including a housing, a light in said housing, a rechargeable battery in said housing energizing said light, at least one sensor energized by said battery in said housing exposed to an environment around said housing and which detects at least one environmental hazard factor selected from fire, harmful gas and air pollution, said sensor producing a respective signal representing detection of said factor, and an alarm;

means connecting said sensors of said devices to said bus by a wave signal transmitted along a normal electrical supply network for transmitting said respective signal representing detection of said environmental hazard factor;

means including a microprocessor connected by a wave signal transmitted along a normal electrical supply network at a central station to said bus for receiving and transmitting and analyzing emergency signals adapted to be carried along said bus and for triggering said alarms from said central station;

means for carrying out programmed self-analysis of said devices along said bus;

electrical supply means connected to said bus for supplying said lighting devices with electrical energy and including a programmable recharging circuit connected to said lighting devices, a circuit for determination of a charging condition connected to said lighting devices, and means for detection of incipient faults, said electrical supply means including a microprocessor circuit connected to said bus with input and output signals for regulating programmed and sequential sequences effecting centralized control, testing and diagnosis of emergency lighting circuits of said lighting devices and of fire, harmful gas and air pollution signals from said sensors;

means at said devices for triggering said alarms directly therefrom without said central station.

2. The system defined in claim 1, further comprising means for remote radio activation of the system.

3. The system defined in claim 1, further comprising means for telephone activation of the system.

* * * * *